United States Patent [19]

Gorlov

[11] Patent Number: 4,818,137

[45] Date of Patent: Apr. 4, 1989

[54] TERRORIST VEHICLE ARRESTING SYSTEM

[75] Inventor: Alexander M. Gorlov, Chestnut Hill, Mass.

[73] Assignee: Flexible Barricades, Inc., Watertown, Mass.

[21] Appl. No.: 128,725

[22] Filed: Dec. 4, 1987

[51] Int. Cl.[4] ..... E01F 13/00

[52] U.S. Cl. ..... 404/6; 49/9; 49/49

[58] Field of Search ..... 404/6, 9, 10; 256/1, 256/13.1; 49/9, 33, 34, 49, 131

[56] References Cited

U.S. PATENT DOCUMENTS

| | | | |
|---|---|---|---|
| 1,848,516 | 3/1932 | Davison | 49/9 |
| 1,848,517 | 3/1932 | Davison | 49/9 |
| 2,306,661 | 12/1942 | Gengler | 49/34 X |
| 2,702,953 | 3/1955 | Heinrich | 49/9 |
| 3,013,750 | 12/1961 | Fonden et al. | 49/9 X |
| 4,490,068 | 12/1984 | Dickinson | 49/49 X |
| 4,509,577 | 4/1985 | Priefert | 49/34 X |
| 4,576,507 | 3/1986 | Terio | 404/6 |
| 4,627,763 | 12/1986 | Roemer et al. | 404/6 |

FOREIGN PATENT DOCUMENTS

| | | | |
|---|---|---|---|
| 932187 | 8/1973 | Canada | 49/49 |
| 149963 | 7/1985 | European Pat. Off. | 49/49 |
| 3112717 | 10/1982 | Fed. Rep. of Germany | 49/49 |
| 2506359 | 11/1982 | France | 49/34 |
| 8203450 | 4/1984 | Netherlands | 404/6 |

*Primary Examiner*—Jerome W. Massie
*Assistant Examiner*—John F. Letchford
*Attorney, Agent, or Firm*—Robert K. Tendler

[57] ABSTRACT

A terrorist vehicle arresting system includes a rigid immovable crash barrier positioned at one side of a driveway and a turnstile having a circular sector positioned at the other side of the driveway in such a manner that upon entrance of an unauthorized vehicle through a corresponding gate across the entrance of the driveway, means are provided to rotate the turnstile such that the turnstile deflects the vehicle into the crash barrier. In a further embodiment, two opposing turnstiles are used to wedge an oncoming vehicle therebetween. In one embodiment, the terrorist vehicle arresting system includes a rope-barrier attached to an elevating and lowering mechanism on one side of the driveway and is attached at its other end to the turnstile, such that upon the unauthorized attempted entrance and the striking of the rope-barrier, the turnstile is rotated by the rope-barrier into the driveway, diverting the vehicle into the crash-barrier.

17 Claims, 7 Drawing Sheets

TERRORIST VEHICLE ARRESTING SYSTEM

FIELD OF THE INVENTION

This invention relates to a method and apparatus for thwarting terrorist attempts at penetrating a gate across a driveway and more particularly to a system for arresting vehicles which is capable of withstanding high impact forces while at the same time preventing penetration, also including the feature of rapid deployment.

BACKGROUND

In the past there have been various vehicle barriers placed directly across roadways to prevent vehicle penetration. One of the difficulties associated with such barriers is that the barrier must be removably placeable across a roadway. Thus, the barrier must be massive enough to arrest a vehicle, yet light enough to be removed for regular vehicular traffic. In order to provide the above-functions, light-weight barriers have been substituted for massive barriers. These light-weight barriers have required expensive and somewhat unreliable brakes or shock absorbing systems, so that the light-weight barrier will not break on impact. Such a system is illustrated in U.S. Pat. No. 4,576,507, in which a barrier is released to come down to attempt to stop a high speed vehicle. In this case, the barrier is prevented from breaking away by virtue of expensive or unyieldy spring-loaded absorbers. By way of further background, in the past, various flexible rail road crossing gates and highway guard fences such as illustrated in U.S. Pat. Nos. 1,848,516; 1,848,517; 3,292,909 have also utilized various types of shock-absorbing mechanisms which includes brakes on drums or other hydraulic and spring-loaded systems. These are likewise complicated and expensive. Note that yieldable barriers used for traffic include U.S. Pat. Nos. 2,295,205 and 1,828,296 which are also cable and drum type braking systems. Flexible impact barriers are illustrated, for example, by U.S. Pat. No. 4,645,375 and a device for arresting airplanes which includes a net that has a shock-absorbing device including a braking system is illustrated in U.S. Pat. No. 3,013,750. Finally, U.S. Pat. No. 1,748,563 illustrates a flexible obstruction device extending across an open driveway to prevent access by gradually bringing an automobile to a stop at a right-of-way, street, or other crossing. Means for providing a retarding force include the paying out of the cables connected to the obstructing device which includes a braking mechanisms to retard the paying out of the cable.

SUMMARY OF THE INVENTION

In contradistinction to all of the above methods of arresting a vehicle traveling along a given direction, in the Subject System, a vehicle is deflected from its direction of travel through the utilization of a turnstile which is moveable into the roadway to deflect the vehicle into a crash barrier to the side of the driveway. The turnstile in one embodiment, includes a sector of a spoked wheel having as a central hub a freely rotatable cylindrical section, with the hub spokes projecting out beyond the sector to engage the vehicle as it comes into contact with the sector. When such occurs the sector continues to rotate in the direction down the driveway to present increasing portions of the sector to the vehicle and further deflect the vehicle off the roadway.

The turnstile is normally at a rest position, with the sector being completely removed from the driveway.

Upon impending impact of an unauthorized vehicle, means are provided to rotate the sector at least partially into the driveway where it is hit by at least a portion of the vehicle coming through the entrance to the driveway. Here the kinetic energy of the vehicle further swings the rotatable sector towards the center of the driveway for assured vehicle deflection. This turnstile therefore redirects the initial vehicle motion along the direction of the driveway and causes the vehicle to be cammed into a different direction, that being in the direction of an immovable crash barrier. Preferably the vehicle comes to rest straddling the driveway to prevent further unauthorized traffic from coming through the gateway.

In one embodiment, for turnstile rotation, a barrier-rope, strand, or wire is raised from a buried position inside the gate, and is moved up to a position which assures that the oncoming vehicle will impact the barrier-rope. One end of the barrier-rope is attached to the turnstile while the other end is anchored at one side of the driveway to the nut of a power-screw, a roller chain and sprocket assembly or any other elevating device which when activated quickly raises the barrier-rope. As the rope is raised it becomes taught across the driveway. When the oncoming vehicle impacts the taught rope, it swings the turnstile into the driveway. In one embodiment shear pins are caused to shear off, such that while the turnstile may be maintained in a normal position not occluding the driveway, upon initial impact, the rope pulls the sector into position, whereby further engagement with the vehicle causes the sector to move further into the driveway. This assures that the vehicle is directed off of the driveway towards the crash barrier at the other side of the driveway.

While there are indeed many mechanisms to actuate the turnstile including internal motors and the like, the above simplified high speed elevator is preferred. Upon actuation of the high-speed screw, the nut is moved upwardly. The nut is attached to one end of the aforementioned barrier-rope such that during a normal position the collar is at the base of the screw which allows the barrier-rope to be embedded into the channel in the surface of the roadway. Upon actuation of the screw, the nut moves upwardly, thereby pulling the rope up out of the channel in the driveway to a position where impingement with the oncoming vehicle is assured.

In a preferred embodiment, the screw or chain elevator is inclined away from the direction of the turnstile such that as the collar moves upwardly, the barrier-rope is tensioned and does not sag. In one embodiment, the barrier-rope carries weighting means which maintain the rope within the channel in the driveway. This mechanism may include either weights surrounding the rope itself or an idler pulley arrangement which is pivoted such that when the rope is in the down position the weighted idler holds the rope down in the channel due to its own weight. Upon screw actuation of the elevator, the tensioning of the rope extends the idler pulley arm upwardly thereby, to permit rope contact with the oncoming vehicle.

It will be appreciated that the turnstile is of a massive nature on free-wheeling bearings, with shear pins to maintain the sector away from the driveway. The sector may, as mentioned before, be motor driven or may be pulled into position by virtue of the aforementioned rope.

For esthetic purposes, the crash barrier may be simply a jog in the guard rail normally utilized off the opposite side of the driveway. In a further embodiment, two turnstiles may be located on opposite sides of the driveway with the turnstiles being rotated into position to squeeze the vehicle therebetween to form a barrier. Note, the initial impact of the vehicle causes a camming action, such as is available with a cam cleat, to close in upon the vehicle for wedging the vehicle and preventing further motion down the driveway.

In summary, a terrorist vehicle-arresting system includes a crash-barrier positioned at one side of a driveway and a turnstile having a circular sector positioned at the other side of the driveway in such a manner that upon entrance of an unauthorized vehicle through a corresponding gate across the entrance of the driveway, means are provided to rotate the turnstile such that the turnstile deflects the vehicle into the crash barrier. In a further embodiment, two opposing turnstiles are used to wedge an oncoming vehicle therebetween. In one embodiment, the turnstile is motor driven whereas in another embodiment, a turnstile is pulled into a position for deflection of the oncoming vehicle by virtue of the impact of the oncoming vehicle with a barrier-rope, strand, or wire positioned above the roadway at about grill level, with one end of the rope being secured to the side of the driveway at which the barrier exists, and with the other end of the strand secured to a portion of the turnstile. Thus when a vehicle impacts the rope, the turnstile is immediately rotated into position such that its sector occludes a portion of the driveway and is used to deflect the vehicle into a barrier at the other side of the driveway. A further improvement includes the sector having spokes to a central hub, which spokes project out beyond the sector and are pointed such that the vehicle is pierced by them upon hitting the sector. This carries the sector further in towards the driveway, thereby to provide surer engagement between the sector and the vehicle so as to prevent dislodgement of the sector with respect to the vehicle.

More particularly, the turnstile includes a 60 degree sector or segment of the wheel which remains stationary until deployment during a crash of an unauthorized vehicle into the above-mentioned wire or barrier-rope. In one embodiment, the barrier-rope or wire is attached from the turnstile to an elevator-post arrangement in which the rope transfers the vehicle's vehicle kinetic energy to operation of the turnstile by turning the turnstile into the driveway upon contact of the vehicle with the barrier-rope. In a further embodiment, the turnstile includes shear pins to retain the turnstile in its off-driveway normal position. In another embodiment, an elevator-post assembly is provided in which the rope is held on a collar close to the ground so that the rope may be buried in a channel in the surface of the driveway. With elevator power-screw or chain actuation, the rope is lifted out of the ground channel so it is at vehicle bumper level, with the elevator power screw or chain being inclined away from the driveway as a means of taking up slack in the rope or wire between the ground position and "at the ready" position.

In another embodiment, a weighted idler-rod maintains the barrier-rope or wire in a ground channel until pulled out of the ground channel by virtue of the aforementioned elevator power-screw or chain. In a single turnstile unit, the rigid barrier may merely be a jog in the guard rail or fence along the driveway which presents a rigid immovable barrier; or the jog in the fence can be eliminated with the vehicle being squeezed by the turnstile in a camming action against a straight fence on the opposite side of the driveway from the turnstile. In a still further embodiment, the aforementioned double turnstile is disposed on diametrically opposite sides of the driveway. Upon actuation the sectors wedge the oncoming vehicle between the opposing sectors of the turnstiles.

For the two opposing turnstile embodiments, two elevator power-screws or chains may be utilized along with a single or double rope-barrier attached to both turnstiles and stretched taught across the gateway.

BRIEF DESCRIPTION OF THE DRAWINGS

These and other features of the Subject Invention will be better understood in connection with the Detailed Description taken in conjunction with the Drawings of which.

DETAILED DESCRIPTION

Figure 1:
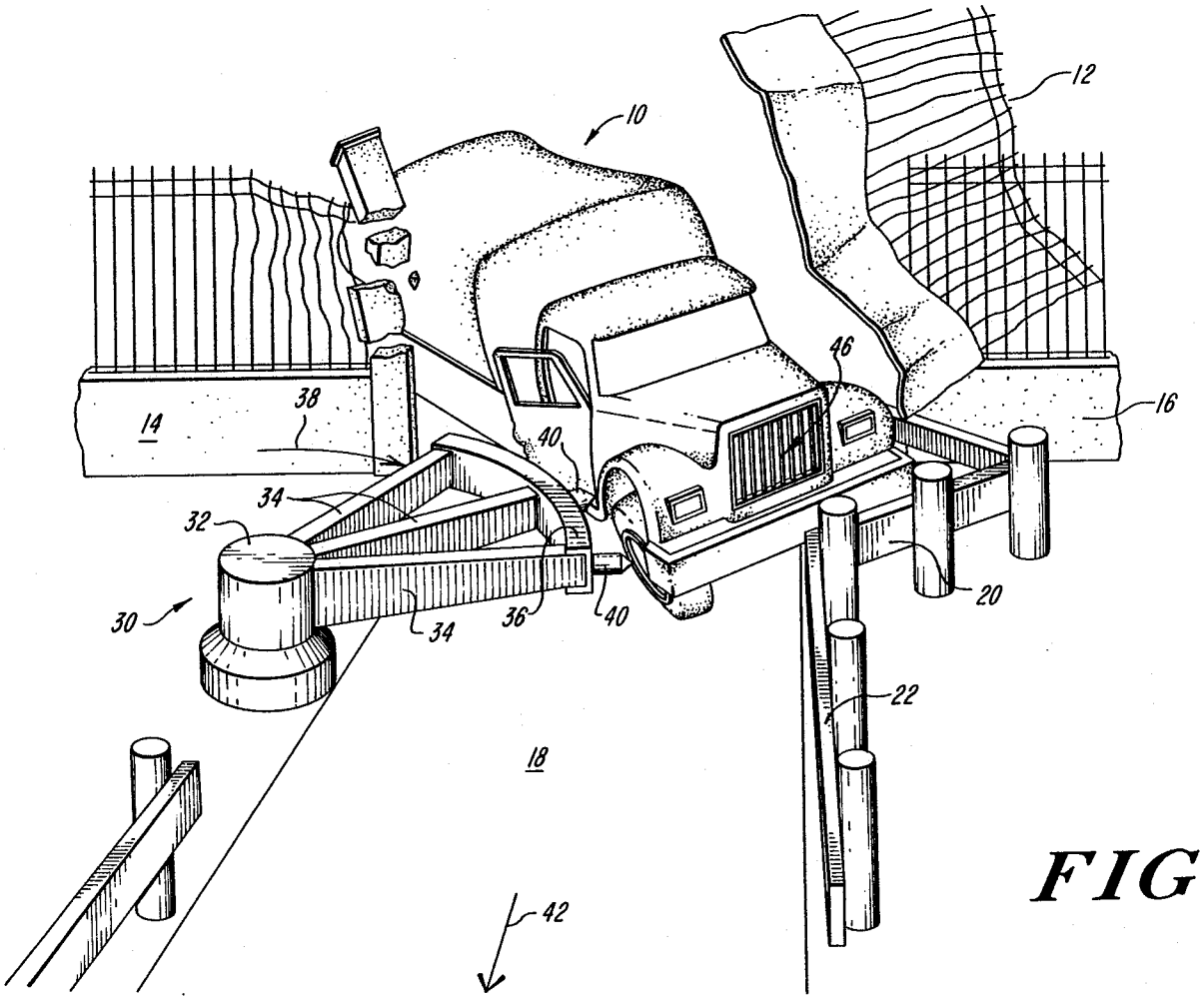
FIG. 1 is a diagrammatic illustration of the Subject System utilizing a sectored turnstile, illustrating the deflection of an oncoming unauthorized vehicle into a jogged crash-barrier which forms an extension of the guard rail normally utilized.

With respect to the Subject Invention, the idea is to deflect a vehicle side ward instead of creation a frontal massive barrier In the Subject Invention, in one embodiment a turnstile is used, which is a rotating barrier that is maintained hidden and does not move until the moment of the crash attempt. The turnstile can be made to appear invisible, save only for a cable being stretched across the driveway in a channel opened at the roadway surface. A cable is needed only to initiate motion of the turnstile, but not to stop a vehicle. A crashing vehicle impacting the cable, when raised, forces the hidden turnstile out into the driveway in a vehicular diversion system in which the vehicle is diverted to a barrier or a rigid guard rail, or into a so-called "squeeze play" type of arrangement. A visible concrete crash barrier may utilized or may be eliminated in favor of a straight rigid guard rail. Currently the guard rails presently utilized are government tested and certified in design.

In one embodiment, as will be described, two photoelectric beams are located in the zone of the turnstile to prevent the aforementioned barrier cable from rising during the movement through the turnstile of an authorized vehicle in or out. Rigid barriers now in use have occasionally malfunctioned and have damaged authorized vehicles including that of an Ambassador. The subject system prevents such an occurrence.

The subject turnstile serves as a type of anti-terrorist vehicle arresting system for high security check points for Government Agencies or can be utilized whenever an unauthorized vehicle is to be prevented from proceeding down a driveway. In one embodiment, as will be seen, a horizontal cable across the driveway is lowered for each vehicle authorized for each passage in or out. This cable can consist of a ¾ inch Kevlar cable, military orange, with a high breaking strength attached to a 60 degree segment of a wheel, with spikes as extensions of the spokes. In the illustrated embodiment, the turnstile is powered by the crashing vehicle which strikes the only visible barrier, the barrier cable stretched across the driveway. This cable utilizes the kinetic energy of the truck to pull the turnstile out to a position where it deflects the direction of travel of a vehicle into a rigid barrier just off the opposite side of the driveway. In one embodiment, the cable is the only moving part of the barrier and may be quickly lowered for authorized passage, and immediately raised thereafter, or upon the detection of an unauthorized approaching vehicle. In one embodiment, the rope barrier may be a single rope, or, in another embodiment, a double rope may be used with netting between the upper and lower rope as shown hereinafter in FIG. 2. In this embodiment one rope can carry a double electric wire to provide for alarm actuation upon cable severing.

The turnstile is therefore designed never to move until that rare occasion when a vehicle attempts to crash through the gate. This simplifies operation, and minimizes motive equipment as well as power.

Two photo-electric beams in the barrier zone break power to the cable-raising mechanism while an authorized vehicle is passing through, thereby avoiding any potential damage to such vehicle. The above-mentioned synthetic cable cannot be cut with knives, scissors or cable cutters except with great difficulty. In one embodiment, the cable is a three strand twisted rope which as mentioned before, can contain insulated electric wire that when cut or severed sounds an alarm.

As will be seen the advantages to the above turnstile gate are that it reduces penetration or stopping distance. Moreover, the vehicle is diverted into a rigid crash barrier off the driveway. The turnstile can be rotated into a retracted position behind an aesthetic gate where it is virtually invisible. In one embodiment, the turnstile may be configured so as to eliminate the necessity of providing a second gate in a sally port configuration. Note that all foundations and structures are far enough off the driveway avoid disruption, of underground utilities.

The turnstile as has been described, diverts the direction of the vehicle to the off-roadway crash bumper or squeezes it against a certified bollard wall. The Subject System therefore reduces the special requirements off the driveway, with turnstile operating behind but not necessarily in conjunction with a sliding gate. Note that existing aesthetic gates may only be of a light-weight construction in that they do not need to prevent vehicular penetration.

The sliding gate in the above-embodiment may be light, ready, and quickly moveable, but is not necessarily slideably attached to the turnstile for rotating the turnstile upon assault attempt.

The turnstile in an alternative environment may be directly connected to the gate by cable system or rack and pinion arrangement; or by separate motor drives. Note that when using a bollard-wall, this structure involves the displacement of sections to allow for location of permanent crash bumpers with adequate impact resistance near the entry gate position and similarly on the opposite side for the turnstile and its post. In one embodiment, both the pivot point and the turnstile in the face of the crash bumper would be approximately 10 feet from the plane of the gate located at the fence line, with a stopping distance held within 20 feet.

It will be appreciated that the Subject System needs no shock-absorbing mechanism whatsoever since a crash barrier is employed to absorb the kinetic energy of the vehicle, and since the turnstile either diverts it into the crash barrier, or squeezes the vehicle to a stop between opposing turnstiles.

Referring now to FIG. 1, a vehicle 10 is shown crashing through an option gate 12 in a gateway between two relatively solid fence portions 14 and 16 which surround a driveway 18. Vehicle 10 is shown redirected towards a crash-barrier portion 20 of guard rail 22, by virtue of a turnstile 30 which is composed of a central cylindrical hub 32 and spokes 34 which position a sector 36 such that upon rotation in the direction of arrow 38 via turnstile rotation means to be described hereinafter, spikes 40 engage a portion of the oncoming vehicle so that the sector deflects it from its original direction as illustrated by arrow 42, off of the driveway and into the crash-barrier. Thus the vehicle finally comes to rest as illustrated, blocking the entrance to the driveway.

Figure 2:
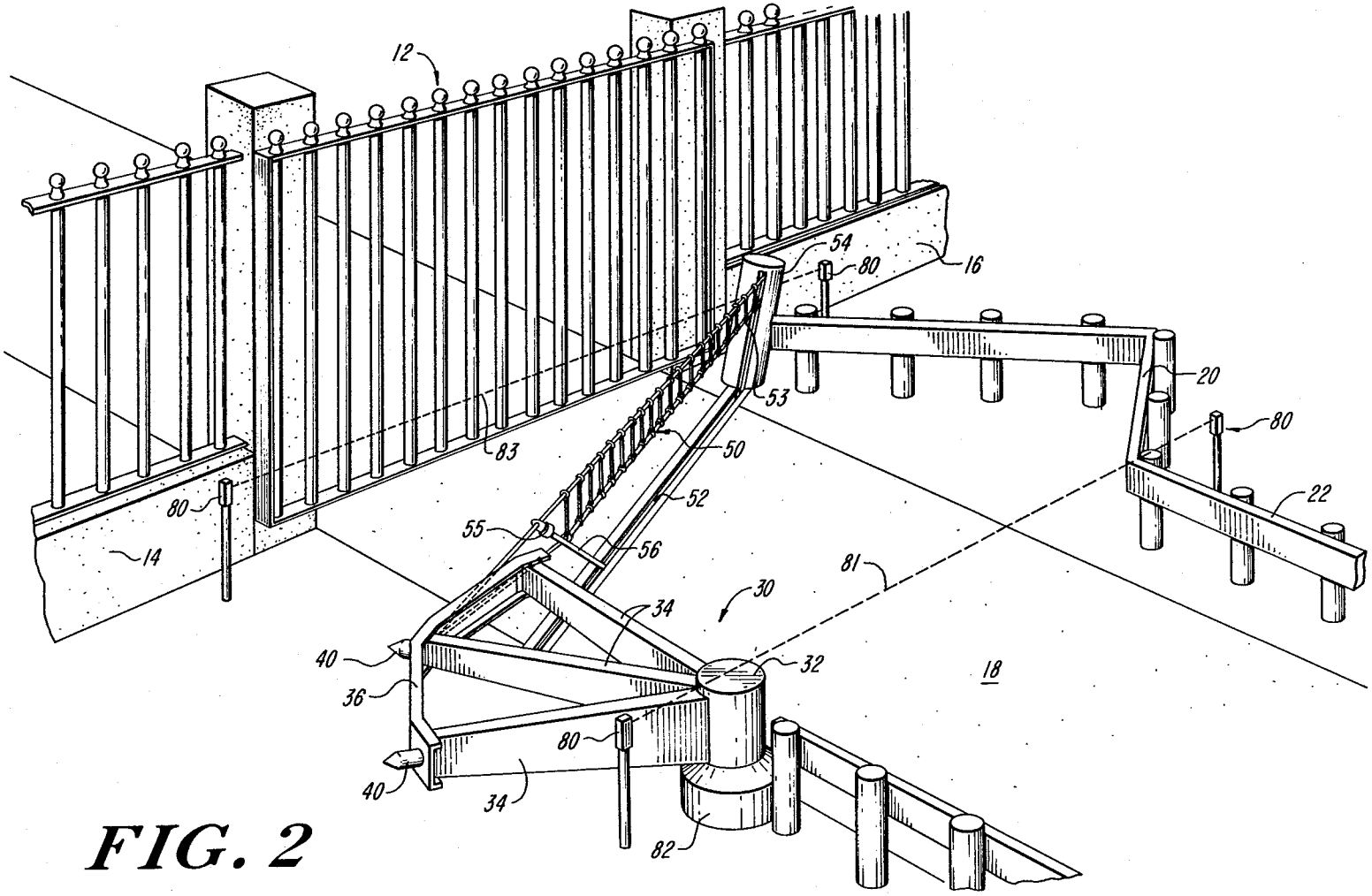
FIG. 2 is a diagrammatic illustration of the raising of a barrier-rope structure, from a channel beneath the highway immediately prior to the impact of the vehicle.

It will be appreciated that turnstile 30 may be rotated into a position behind the qateway and camouflaged or can be hidden until it is actuated upon encroachment of an unauthorized vehicle. As will be described, in one embodiment, a barrier-rope is quickly raised to engage the front portion 46 of the oncoming vehicle. As illustrated in FIG. 2, in which like elements contain like reference characters, it can be seen that one means for rotating turnstile 30 from its rest position is shown by a barrier-rope 50 which is initially stored in a channel 52 in the surface of the driveway. This barrier rope may be singular or multiple with a net therebetween as shown.

This stored rope is raised as shown through the utilization of a inclined and canted power-screw or chain-driven elevator 54 to raise the barrier-rope from its rest position at or beneath the level of the driveway to a taught position capable of engaging the front portion 46 of the vehicle of FIG. 1. Upon engagement with the rope, the turnstile hub 32 revolves around internal bearings such as ball bearings, roller bearings, or friction bearings, which are firmly secured in the hub set within the driveway structure to a cement base. As the vehicle moves forward along the driveway, the turnstile is rotated so as to occlude a portion of the driveway, thereby to redirect the kinetic energy of the truck towards the crash barrier portion of the guard rail. It will be appreciated that this crash portion may be reinforced in any desirable manner or in fact can be reinforced through the utilization of concrete, steel, or like materials, if such is desired.

It will be seen in FIG. 2 that barrier-rope 50 includes a slack take-up weight 55 which is attached to a pivot arm 56 such that when the barrier-rope is lowered the weight keeps the rope maintained in channel 52.

As described hereinbefore, the inclination of elevator 54 permits tensioning of the barrier-rope upon raising rope end 53 from its lower initial position to its raised position. This causes the rope to stretch out and become taut, thereby to pull the turnstile into a position where it can deflect or cam the vehicle into the crash barrier.

Note in the Subject System, the oncoming vehicle is stopped so that it prevents other vehicles from entering down the driveway.

Figure 3A:
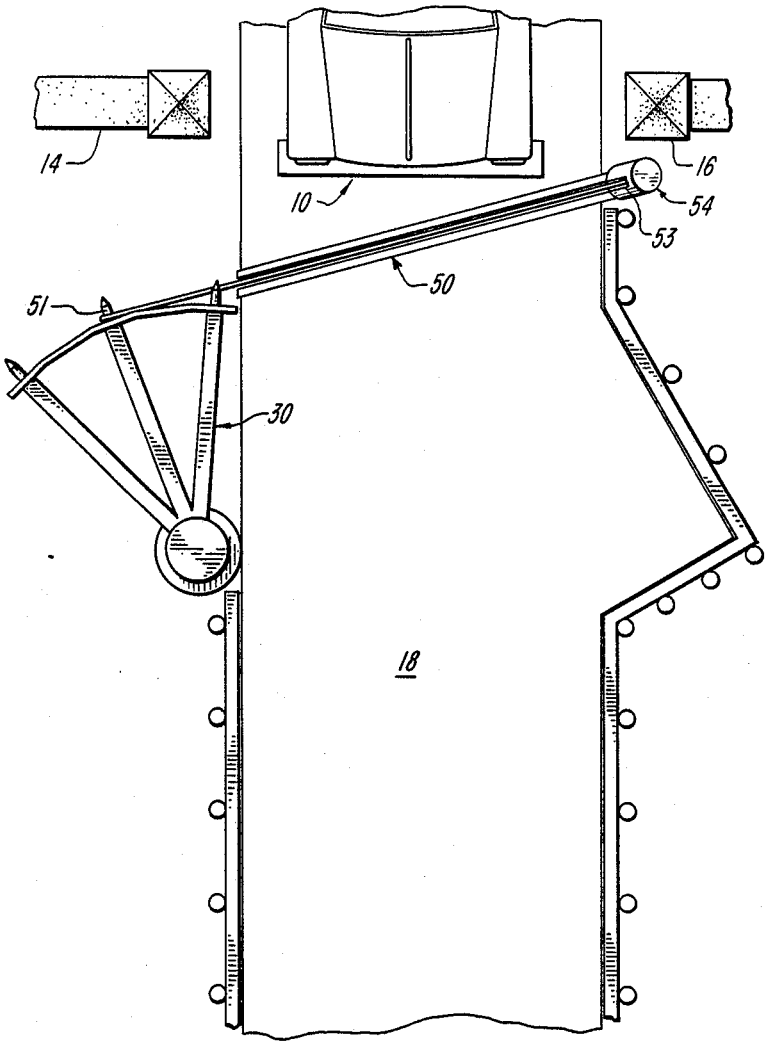
FIGS. 3A, 3B, and 3C are diagrammatic illustrations showing the sequence of events upon the entry of an unauthorized vehicle through a gate illustrating in FIG. 3A the position of the vehicle to just prior to impacting the barrier-rope, in FIG. 3B the penetration vehicle past the barrier-rope showing the initial rotation of the turnstile into the driveway; and with FIG. 3C showing the vehicle deflected into the crash barrier due to the further rotation of the turnstile.
Figure 3B:
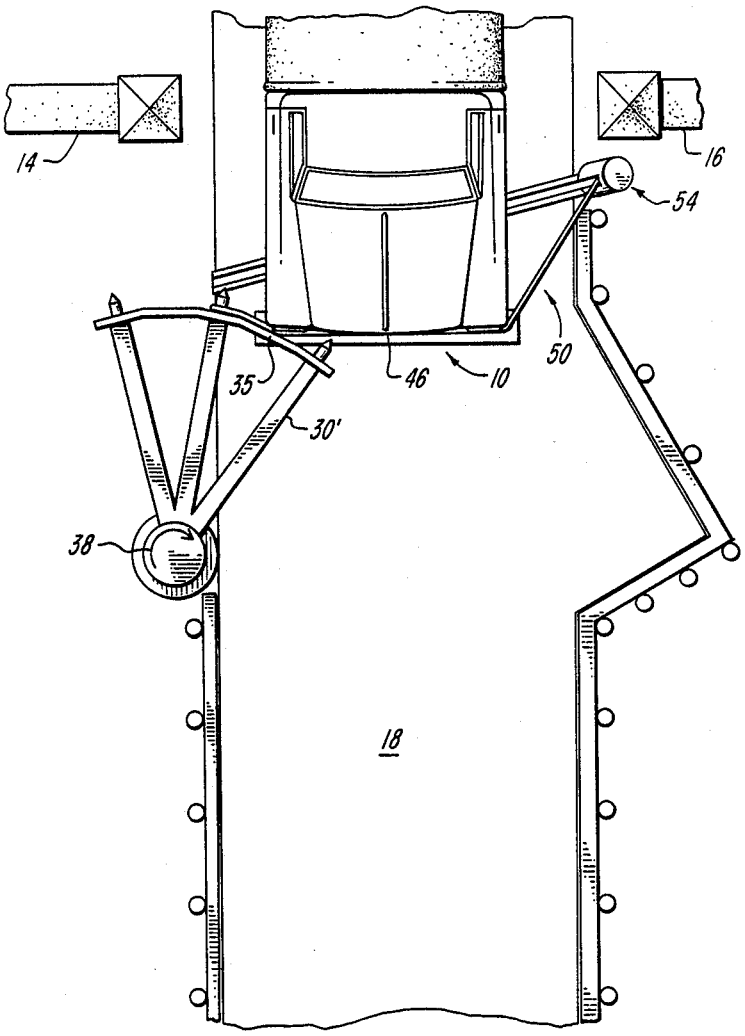
Figure 3C:
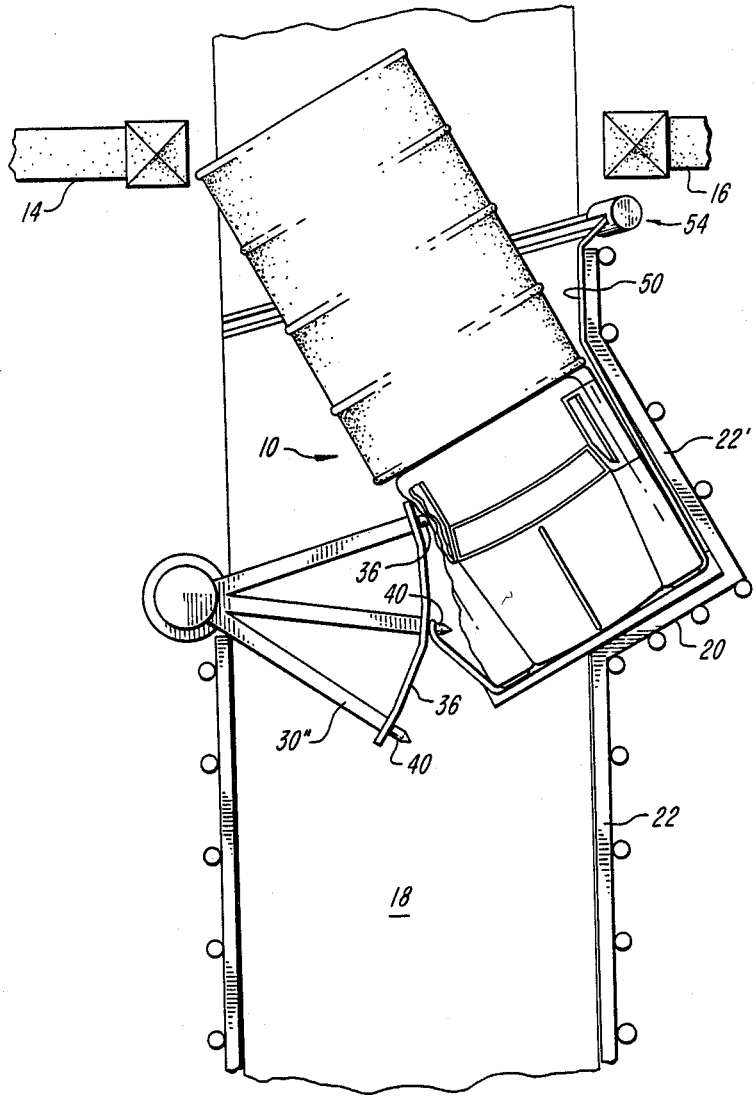

Referring now to FIG. 3A, 3B, and 3C it will be seen that as the truck or other vehicle approaches the gate, the barrier-rope is raised "to the ready" position and with the rope being attached to the turnstile at point 51 at one end thereof, and end 53 to a nut on the power-screw at the other end thereof. As the truck progresses through the gate the barrier-rope lies across the front end 46 of the vehicle for pulling the turnstile so that it rotates as illustrated by arrow 31; at which point the turnstile engages the truck at the position indicated by reference character 35. As the truck proceeds further down driveway 18 and as illustrated in FIG. 3C, the truck is made to impinge upon barrier portion of guard rail 20, with the side of the truck also being pinned to guard rail portion 22' by the wedging action of the turnstile.

It will be appreciated that while the Subject turnstile is illustrated as having pointed extremities 40, sufficient rotation of sector 36 occurs with or without these points so as to deflect this vehicle from its normal direction into the crash-barrier.

Figure 4:
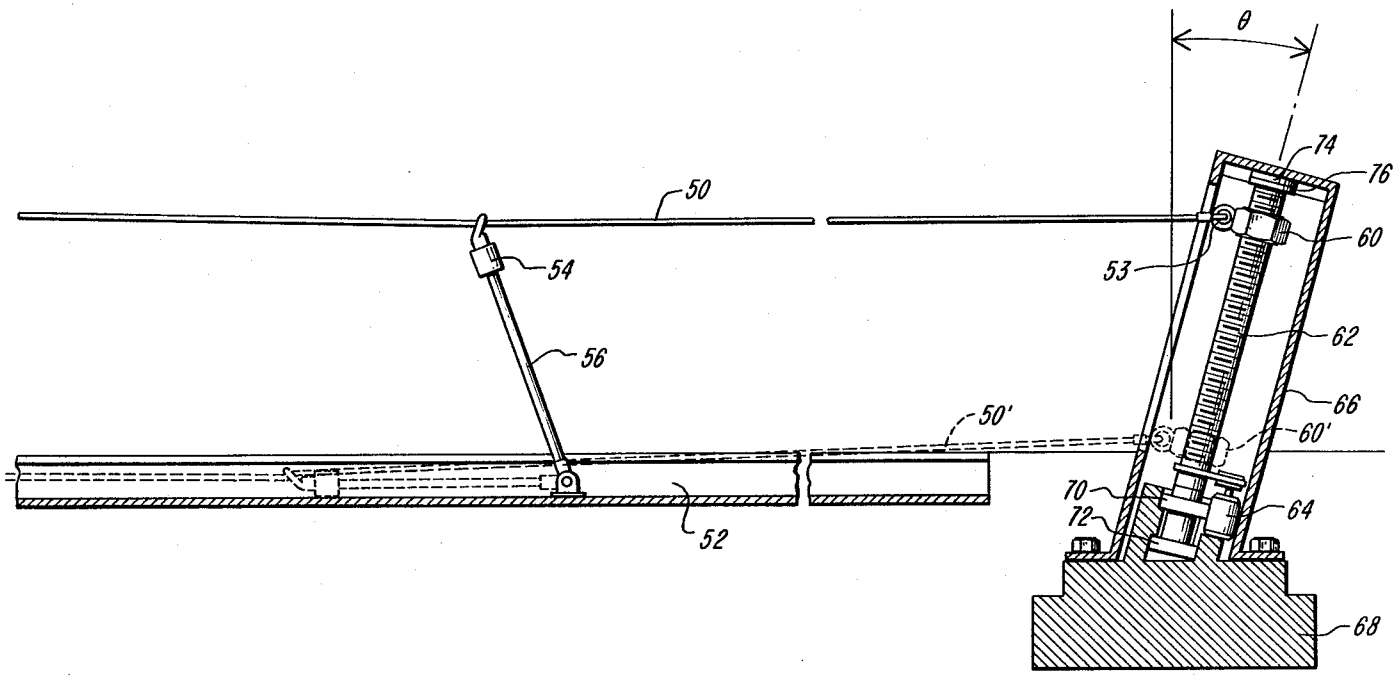
FIG. 4 is a cross-sectional and diagrammatic illustration of the elevator power-screw type actuation for the barrier-rope, also showing the utilization of a weighted hinged idler pulley to maintain the rope in a down position in a channel within the roadway.

Referring now to FIG. 4, in one embodiment the barrier-rope 50 has its end 53 attached to a nut 60 which is threaded to a lead screw 62 actuated by a motor 64 within a housing 66, such that upon actuation of a motor 64, due to the canting of the screw illustrated by the angle, about 9°, the original slack necessary to keep the barrier-rope in channel 52 as shown by dotted outline 50' and 60' is taken up. The rapid rotation of the lead screw raises both the weighted rod 54 and 56 out of channel 52 as well as the barrier-rope. Note that with gear reduction means being utilized to rapidly rotate the lead screw, such that the barrier-rope may be raised in less than one second. Note also that the lead screw is securely mounted to the housing 66 which is secured to a substantial base 68 so as to be able to withstand the impact of the vehicle crashing through the gateway at least in so far as being able to provide for the movement of the turnstile.

In one embodiment, lead screw is made of steel and is anchored through bearings 70 and 72 to massive base 68. The top part of the lead screw is also secured at its top portion 74 via a bearing 76 to the top portion of housing 66. The housing is secured in position by any appropriate means so as to sustain an angle which in one embodiment is about 9°. It will be appreciated that lever 56 and its corresponding weight 54 may be replaced by a weighted rope having weights strung therealong or at one portion thereof.

Photo-electric sensors generally indicated by reference character 80 in FIG. 2 may be used to define a zone therebetween in which when actuated and a vehicle breaks beam 81 or 83 all power is cut to the lead screw. This prevents against accidental actuation of the barrier-rope and turnstile should the an authorized vehicle proceed through the protected zone. The provision of a safe zone prevents accidental actuations which may cause damage to authorized vehicles or at least embarrassment of the persons therein.

With respect to the strength of the turnstile and its ability to withstand impact, it will be appreciated that the dimensions for a turnstile and its base shown in FIG. 2 at reference character 82 are such that the bottom thereof may be anchored to a substantial subsurface concrete base with an upstanding shaft about which are placed bearings such that the entire structure can withstand loading conditions such as may be supplied by kinetic energy of 1,250,000 foot. pounds.

Figure 5:
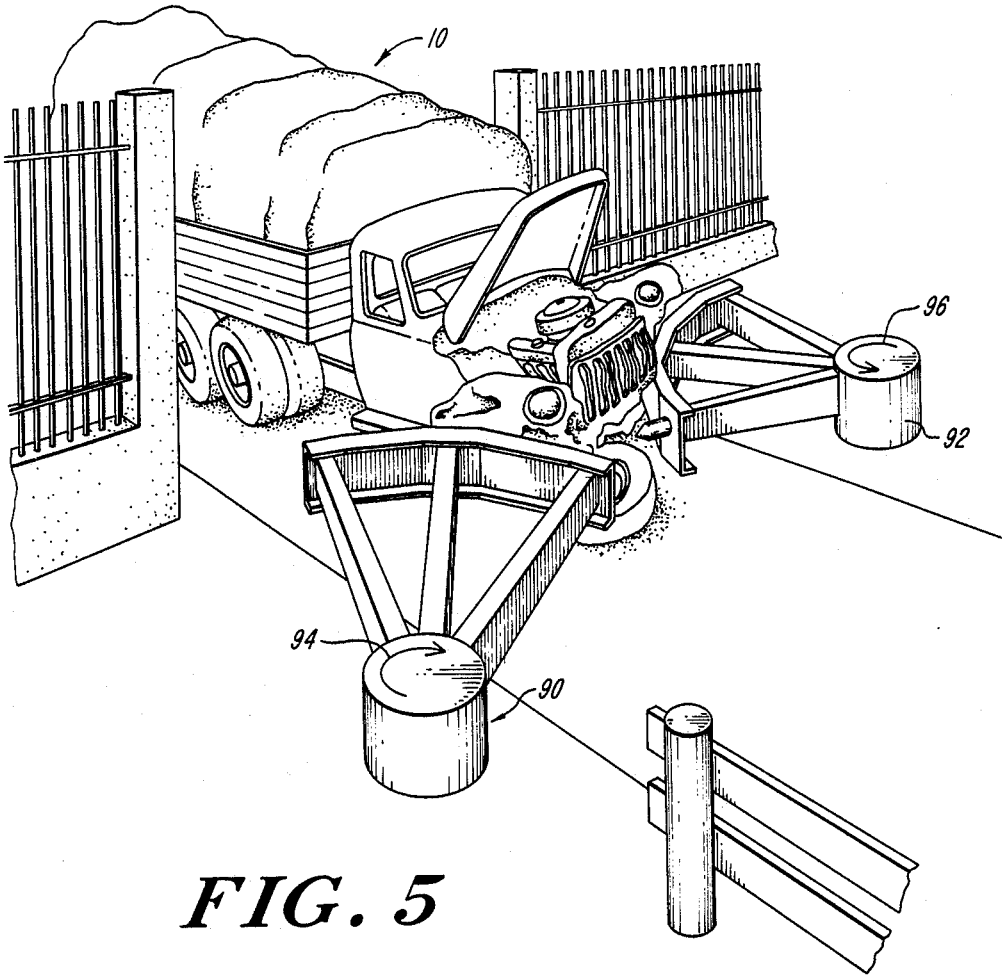
FIG. 5 is a diagrammatic illustration of opposing turnstiles which wedge an oncoming vehicle therebetween.

Referring to FIG. 5, two turnstiles here illustrated by reference characters 90 and 92 are shown wedging a vehicle 10 therebetween upon rotation as illustrated by arrows 94 and 96. In this embodiment the actuation may be by a crash rope attached to both turnstiles or by a pair of the barrier-ropes or may be done via motor control, be it hydraulic or electric. It will be appreciated that no crash barrier is provided in this case in the sense that the two turnstiles operate to prevent passage of a vehicle therethrough a wedging action.

Having above indicated a preferred embodiment of the present invention, it will occur to those skilled in the art that modifications and alternatives can be practiced within the spirit of the invention. It is accordingly intended to define the scope of the invention only as indicated in the following claims.

I claim:

1. A terrorist vehicle arresting system for precluding the onward travel of an encroaching vehicle through a gateway down a driveway comprising:

a turnstile having a sector and positioned to one side of said driveway, said sector being of a size which when said turnstile is rotated occludes at least a portion of said driveway adjacent said gateway;

an immovable crash barrier positioned at the other side of said driveway adjacent said gateway; and means for rotating said turnstile sector into said driveway upon approach of an encroaching vehicle, thereby to deflect said vehicle into said crash barrier.

2. The terrorist vehicle arresting system of claim 1 wherein said turnstile includes a central hub and spokes connecting said central hub to said sector, said spokes projecting outwardly of said sector and being adapted to engage said encroaching vehicle.

3. The terrorist vehicle arresting system of claim 1 wherein said turnstile rotating means includes motor-power activating means for rotating said turnstile into said driveway.

4. The terrorist vehicle arresting system of claim 1 and further including means defining a zone about said driveway which, when a vehicle of an authorized nature is within said zone, said means for rotating said turnstile are inactivated.

5. The terrorist vehicle arresting system of claim 1 wherein said immovable crash barrier includes a bollard wall.

6. The terrorist vehicle arresting system of claim 1 wherein said immovable crash barrier includes a bollard wall having a jogged portion thereof to provide said crash barrier.

7. The terrorist vehicle arresting system of claim 1 wherein said turnstile rotating means includes a barrier cable attached at one end to said turnstile and at another end thereof to a position at the opposite side of said driveway from said turnstile.

8. The terrorist vehicle arresting system of claim 7 wherein said barrier cable includes means for sensing the severing thereof.

9. The terrorist vehicle arresting system of claim 7 wherein said system includes elevator means at said other side of said driveway for raising said barrier cable, said other end of said barrier cable being secured to said elevator means.

10. The terrorist vehicle arresting system of claim 9 wherein said elevator means includes means for moving said other end of said barrier cable from a ground level position to a raised position.

11. The terrorist vehicle arresting system of claim 10 wherein said elevator means includes a lead-power screw arrangement.

12. The terrorist vehicle arresting system of claim 10 wherein said elevator means includes a chain drive system.

13. The terrorist vehicle arresting system of claim 10 wherein said elevator means includes means for moving said other end of said barrier cable from a ground position to an upward position along a slant, said slant being away from said turnstile such that upon the raising of said cable, said cable is made taut and is in a position to engage said encroaching vehicle as it comes through said gateway.

14. The terrorist vehicle arresting system of claim 10 wherein said cable is weighted.

15. The terrorist vehicle arresting system of claim 14 wherein said weighting system includes weights disposed along the length of said cable.

16. The terrorist vehicle arresting system of claim 14 wherein said weighting system includes a pivoted arm having a pulley at the non-pivoted end thereof, with the cable passing through said pulley and with the weight of said arm pulling said cable to the ground upon lack of tension thereon.

17. The terrorist vehicle arresting system of claim 10 and further including a channel in said driveway adapted to receive said cable when said cable is in a lowered position.

* * * * *